US012235020B2

(12) United States Patent
Kakizaki

(10) Patent No.: US 12,235,020 B2
(45) Date of Patent: Feb. 25, 2025

(54) WATER HEATER

(71) Applicant: PALOMA CO., LTD, Nagoya (JP)

(72) Inventor: Yusuke Kakizaki, Nagoya (JP)

(73) Assignee: PALOMA RHEEM HOLDINGS CO., LTD., Tokyo (JP)

( * ) Notice: Subject to any disclaimer, the term of this patent is extended or adjusted under 35 U.S.C. 154(b) by 164 days.

(21) Appl. No.: 18/312,796

(22) Filed: May 5, 2023

(65) Prior Publication Data

US 2023/0358441 A1 Nov. 9, 2023

(30) Foreign Application Priority Data

May 9, 2022 (JP) ..... 2022-077169

(51) Int. Cl.

| | |
|---|---|
| ***F23L 17/04*** | (2006.01) |
| ***F22B 37/06*** | (2006.01) |
| ***F24H 9/00*** | (2022.01) |
| ***F24H 9/13*** | (2022.01) |

(52) U.S. Cl.

CPC ..... *F24H 9/0026* (2013.01); *F24H 9/13* (2022.01)

(58) Field of Classification Search

CPC ..... F24H 1/205; F24H 1/282; F23L 17/04; F23L 15/04; F23L 11/00; F23L 13/06; F22B 27/00; F22B 35/005; F22B 37/06; F22B 7/18

See application file for complete search history.

(56) References Cited

U.S. PATENT DOCUMENTS

| | | | | |
|---|---|---|---|---|
| 6,647,977 | B2 * | 11/2003 | Lesage | F23L 17/04 126/307 R |
| 8,113,154 | B2 * | 2/2012 | Syler | F23J 13/025 122/155.1 |
| 8,552,574 | B2 * | 10/2013 | Sasaki | F23J 13/025 290/1 A |
| 9,140,450 | B2 * | 9/2015 | Jacklich | F23J 13/025 |
| 11,421,915 | B2 * | 8/2022 | Oliver | F24H 15/219 |
| 2016/0060873 | A1 * | 3/2016 | Sugatani | F23J 11/00 29/401.1 |

FOREIGN PATENT DOCUMENTS

| | | | | |
|---|---|---|---|---|
| CA | 2974424 | A1 * | 1/2018 | F04D 25/06 |
| CN | 107084400 | A * | 8/2017 | F23J 13/02 |
| JP | H0791643 | A * | 4/1995 | |
| JP | H7-22593 | Y2 | 5/1995 | |

* cited by examiner

*Primary Examiner* — Gregory A Wilson
(74) *Attorney, Agent, or Firm* — Oliff PLC

(57) ABSTRACT

A water heater connectable to an external air supply and exhaust pipe includes a housing that houses a combustion device, a connecting portion, a first air supply and exhaust pipe, and a second air supply and exhaust pipe. The connecting portion includes an outer cylinder and an inner cylinder projecting upward from an upper surface of the housing. The first air supply and exhaust pipe and the second air supply and exhaust pipe are selectively connectable to the connecting portion. The first air supply and exhaust pipe is connectable to the connecting portion by interpolating a first air supply pipe into the outer cylinder and interpolating a first exhaust pipe into the inner cylinder, and the second air supply and exhaust pipe is connectable to the connecting portion by externally fitting a second air supply pipe onto the outer cylinder and interpolating a second exhaust pipe into the inner cylinder.

4 Claims, 12 Drawing Sheets

WATER HEATER

CROSS REFERENCE TO RELATED APPLICATION

This application claims the benefit of Japanese Patent Application Number 2022-077169 filed on May 9, 2022, the entirety of which is incorporated by reference.

FIELD

The disclosure relates to a forced air supply and exhaust type water heater that takes in combustion air into an apparatus by driving a fan disposed in the apparatus to supply the combustion air to a burner and discharge combustion exhaust gas that has passed through a heat exchanger to an outside.

BACKGROUND

A water heater is formed by housing a combustion device, such as a burner, a heat exchanger, and a fan, in a housing. In an upper portion of the combustion device, a connecting portion including an inner cylinder projecting upward and an outer cylinder coaxially surrounding the inner cylinder is formed. A separate air supply and exhaust pipe that includes an exhaust pipe extending in an up-down direction and an air supply pipe coaxially surrounding the exhaust pipe is connected to the connecting portion. The air supply and exhaust pipe is arranged outside a building in a state where the exhaust pipe is communicated with the inner cylinder and the air supply pipe is communicated with the outer cylinder (for example, see JP H7-22593 Y).

Accordingly, when the fan inside the housing is driven, outside air is taken in from the air supply pipe of the air supply and exhaust pipe, enters an apparatus via the outer cylinder, and is supplied to the burner as combustion air. After combustion exhaust gas generated by combustion of the burner passes through the heat exchanger to undergo heat exchange, the combustion exhaust gas passes through the exhaust pipe of the air supply and exhaust pipe via the inner cylinder and is discharged outside the building.

In the conventional forced air supply and exhaust type water heater described above, the connecting portion is compatible only with one kind of air supply and exhaust pipe having a specific diameter, and another type of air supply and exhaust pipe having a different diameter cannot be connected.

Therefore, it is an object of the disclosure to provide a water heater to which two types of air supply and exhaust pipes having different diameters are connectable.

SUMMARY

In order to achieve the above-described object, the disclosure provides a water heater connectable to an external air supply and exhaust pipe coaxially including an outer side air supply pipe and an inner side exhaust pipe. The water heater includes a housing, a connecting portion, a first air supply and exhaust pipe, and a second air supply and exhaust pipe. The housing houses a combustion device including a fan. The connecting portion is connectable to the external air supply and exhaust pipe and includes an outer cylinder and an inner cylinder projecting upward from an upper surface of the housing. The outer cylinder is for taking in air into the housing in association with driving of the fan. The inner cylinder is coaxially arranged in the outer cylinder. The inner cylinder is for discharging combustion exhaust gas that has passed through the combustion device. The first air supply and exhaust pipe coaxially includes a first air supply pipe corresponding to the outer cylinder and a first exhaust pipe corresponding to the inner cylinder. The second air supply and exhaust pipe coaxially includes a second air supply pipe corresponding to the outer cylinder and having an inner diameter larger than an outer diameter of the first air supply pipe and a second exhaust pipe corresponding to the inner cylinder. The first air supply and exhaust pipe and the second air supply and exhaust pipe are selectively connectable to the connecting portion. The first air supply and exhaust pipe is connectable to the connecting portion by interpolating the first air supply pipe into the outer cylinder and interpolating the first exhaust pipe into the inner cylinder. The second air supply and exhaust pipe is connectable to the connecting portion by externally fitting the second air supply pipe onto the outer cylinder and interpolating the second exhaust pipe into the inner cylinder.

According to another aspect of the disclosure, in the above-described configuration, an outer diameter of a lower portion of the second exhaust pipe is smaller than an outer diameter of a lower portion of the first exhaust pipe. A first air supply pipe restricting portion is disposed on an inner surface of the outer cylinder, and a second air supply pipe restricting portion is disposed on an outer surface of the outer cylinder, separately at upper and lower parts, respectively. The first air supply pipe restricting portion restricts an interpolation position of the first air supply pipe. The second air supply pipe restricting portion restricts an external fitting position of the second air supply pipe. A first exhaust pipe restricting portion and a second exhaust pipe restricting portion are disposed on the inner cylinder. The first exhaust pipe restricting portion restricts an interpolation position of the first exhaust pipe. The second exhaust pipe restricting portion restricts an interpolation position of the second exhaust pipe at a lower position than the first exhaust pipe restricting portion. A first sealing member and a second sealing member are disposed separately at upper and lower parts on an inner peripheral surface of the inner cylinder, respectively. The first sealing member abuts on an outer peripheral surface of the interpolated first exhaust pipe. The second sealing member abuts on an outer peripheral surface of the interpolated second exhaust pipe. When the first air supply and exhaust pipe is connected to the connecting portion, interpolation of the first air supply pipe interpolated into the outer cylinder is restricted by the first air supply pipe restricting portion, interpolation of the first exhaust pipe interpolated into the inner cylinder is restricted by the first exhaust pipe restricting portion, and the first sealing member abuts on the outer peripheral surface of the first exhaust pipe. When the second air supply and exhaust pipe is connected to the connecting portion, external fitting of the second air supply pipe externally fitted onto the outer cylinder is restricted by the second air supply pipe restricting portion, interpolation of the second exhaust pipe interpolated into the inner cylinder is restricted by the second exhaust pipe restricting portion, and the second sealing member abuts on the outer peripheral surface of the second exhaust pipe.

According to another aspect of the disclosure, in the above-described configuration, the first exhaust pipe restricting portion is a tapered portion tapered off as heading downward and having a diameter smaller than an outer diameter of a lower end of the first exhaust pipe and larger than an outer diameter of the second exhaust pipe.

According to another aspect of the disclosure, in the above-described configuration, a connecting member coaxially connecting both cylinders is installed between an inner surface of the outer cylinder and an outer surface of the inner cylinder, and an upper end of a connecting part in the connecting member for connection to the inner surface of the outer cylinder is doubled as the first air supply pipe restricting portion.

With the disclosure, the first air supply and exhaust pipe is connectable to the connecting portion by interpolating the first air supply pipe into the outer cylinder and interpolating the first exhaust pipe into the inner cylinder. The second air supply and exhaust pipe is connectable to the connecting portion by externally fitting the second air supply pipe onto the outer cylinder and interpolating the second exhaust pipe into the inner cylinder. Accordingly, any of the two types of first and second air supply and exhaust pipes having different diameters is connectable to the connecting portion.

With another aspect of the disclosure, in addition to the above effect, the first and second air supply and exhaust pipes are connectable to the connecting portion at appropriate positions by disposing restricting portions in the outer cylinder and the inner cylinder. Moreover, it is possible to reliably seal between the inner cylinder and the first and second exhaust pipes, thus allowing avoidance of combustion exhaust gas leakage.

With another aspect of the disclosure, in addition to the above effect, the first exhaust pipe can be appropriately positioned while allowing passage of the second exhaust pipe longer downward than the first exhaust pipe by forming the first exhaust pipe restricting portion to be a tapered portion having a diameter smaller than the lower end outer diameter of the first exhaust pipe and a diameter larger than the outer diameter of the second exhaust pipe.

With another aspect of the disclosure, in addition to the above effect, since the connecting part in the connecting member for connection to the inner surface of the outer cylinder doubles as the first air supply pipe restricting portion, insertion of the first air supply pipe can be restricted using the connecting member, resulting in a rational configuration with the number of components reduced.

DETAILED DESCRIPTION OF THE EMBODIMENTS

The following describes an embodiment of the disclosure based on the drawings.

Figure 1:
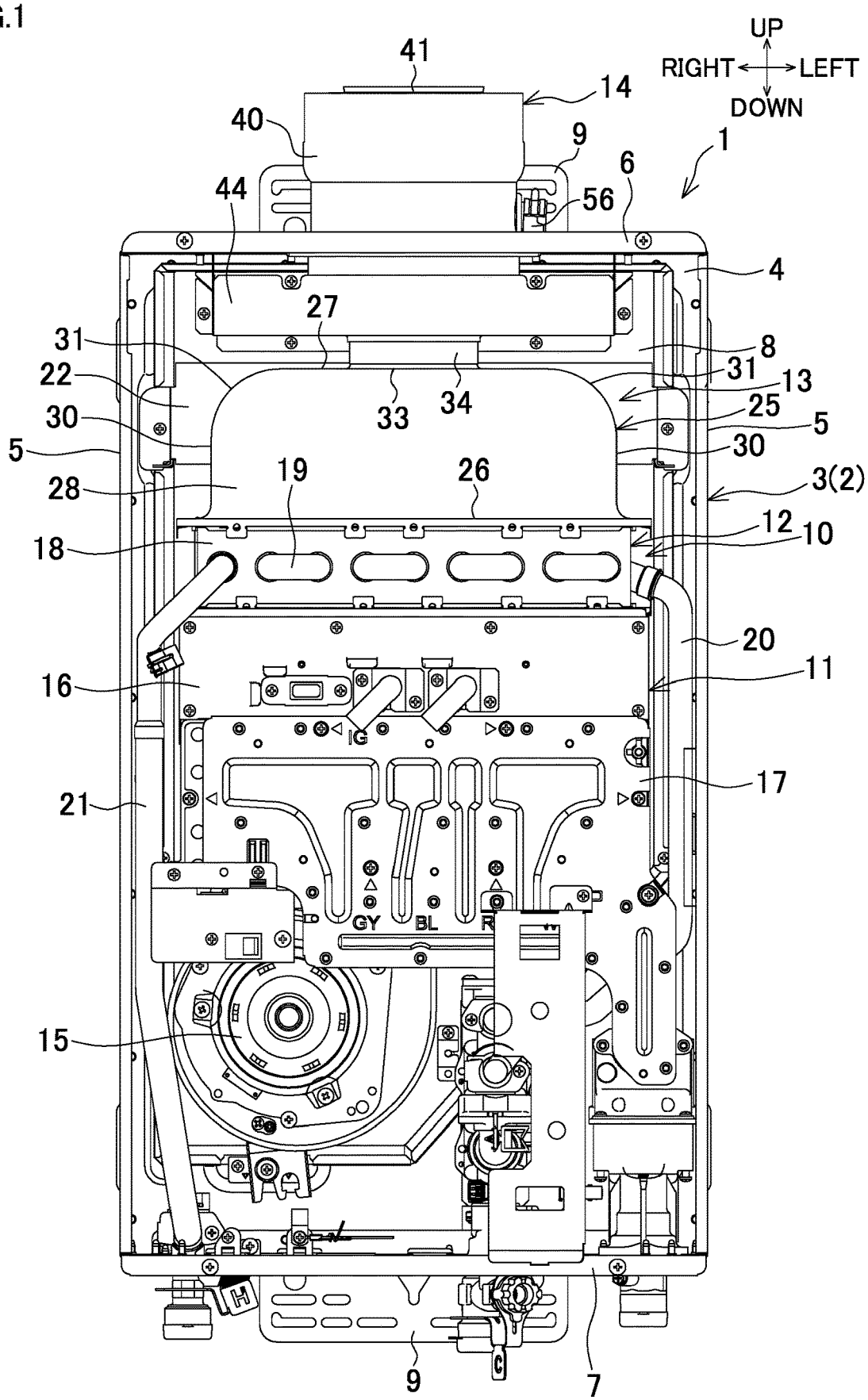
FIG. 1 is a front view of a water heater with a front cover removed.

FIG. 1 is a front view illustrating an exemplary water heater and illustrates a state where a front cover is removed.

A water heater 1 includes a housing 2 having a rectangular shape in front view. The housing 2 has an open front face and is formed of a box main body 3 having a deep bottom in the front and rear, and a front cover (not illustrated) that closes the front face of the box main body 3 and has a bottom shallower than the box main body 3. The box main body 3 includes a back plate 4, right and left side plates 5, 5, a top plate 6, and a bottom plate 7. The back plate 4 has a front face to which an installation plate 8 is attached. Respective brackets 9, 9 for installation to a vertical plane of a wall surface or the like are attached to upper and lower parts of a rear face of the back plate 4.

In the box main body 3, a combustion device 10, which includes a burner unit 11, a heat exchanger 12, and an exhaust hood 13 in order from the bottom, is installed. A connecting portion 14 for connection to an air supply and exhaust pipe described later is disposed on an upper side of the exhaust hood 13. The burner unit 11 has a lower portion in which a fan 15 having a fan motor is disposed. A controller (not illustrated) is disposed in front of the fan 15.

The burner unit 11 houses a plurality of burners (not illustrated) in a lower casing 16. The lower casing 16 has a front face on which a nozzle base 17 for supplying fuel gas to the burners are disposed.

The heat exchanger 12 includes an upper casing 18 connected to the upper side of the lower casing 16. A heat transfer pipe 19 arranged in a meandering manner is disposed in the upper casing 18. The heat transfer pipe 19 has an upstream end connected to a water supply pipe 20 and a downstream end connected to a hot water outlet pipe 21. The water supply pipe 20 and the hot water outlet pipe 21 are to be connected to external pipes on a lower side of the bottom plate 7.

Figure 2:
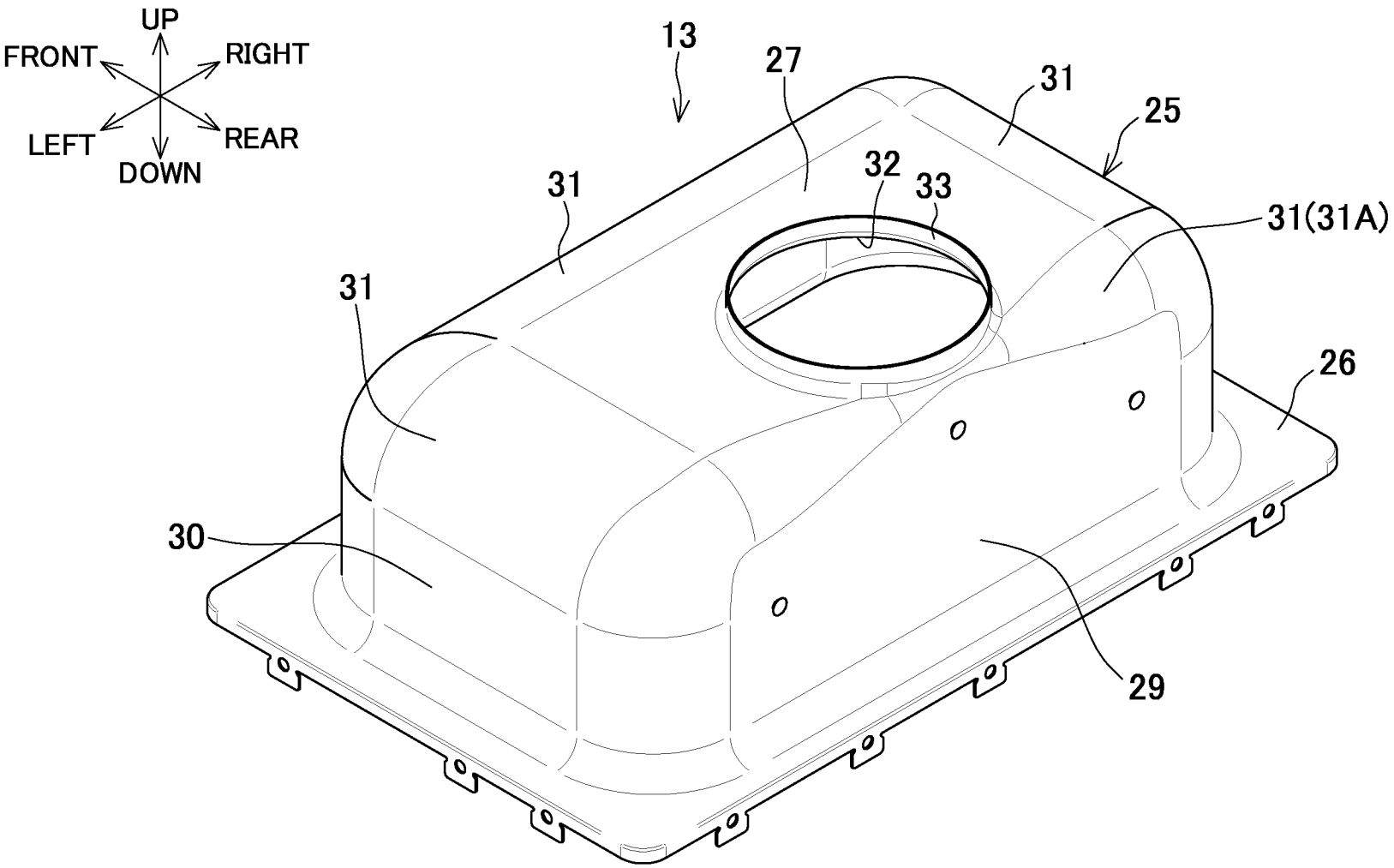
FIG. 2 is a perspective view from a rear of an exhaust hood.
Figure 3:
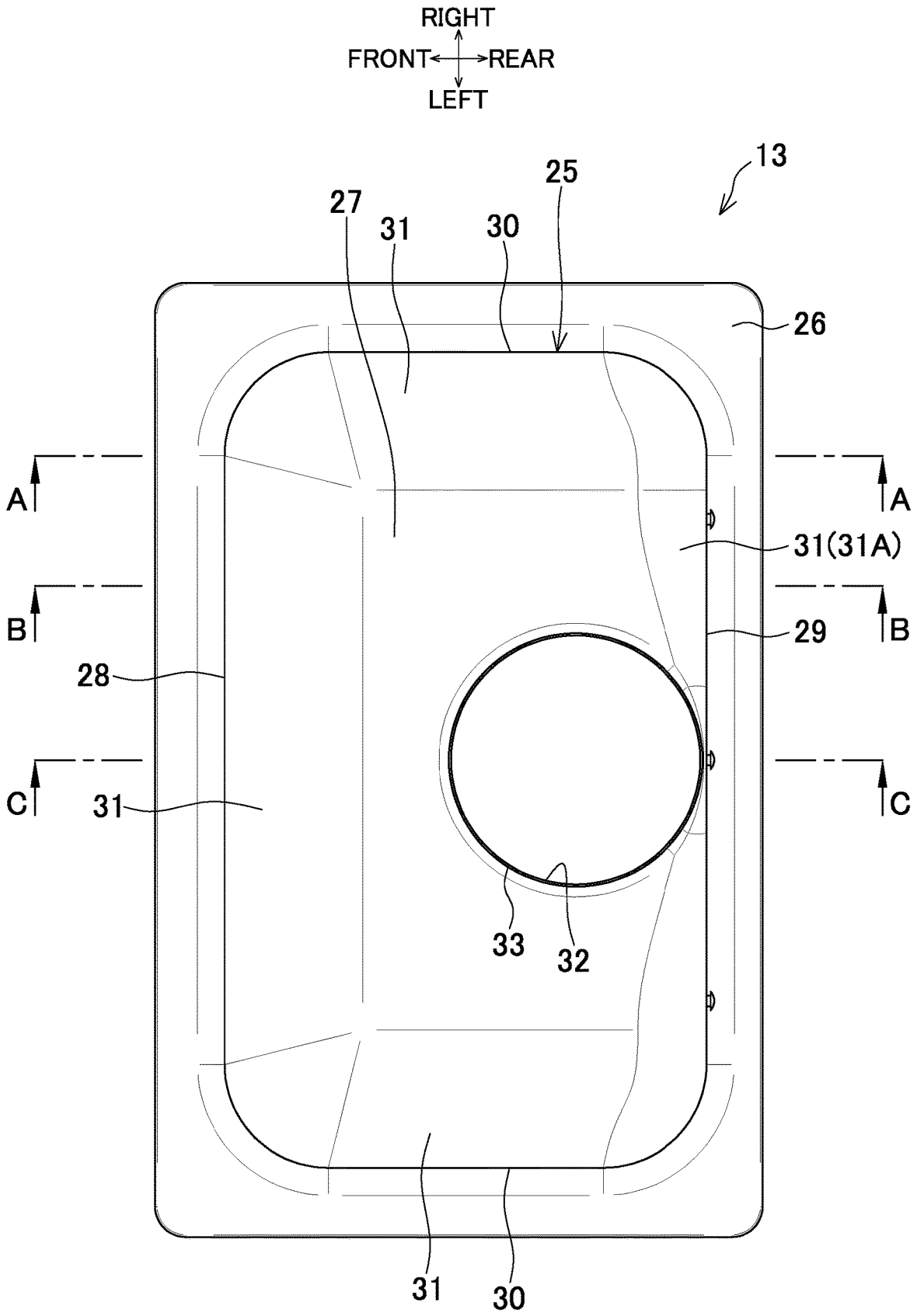
FIG. 3 is a plan view of the exhaust hood.

The exhaust hood 13 is attached to an upper end of the upper casing 18. As illustrated in FIG. 2 and FIG. 3, the exhaust hood 13 includes a box-shaped main body portion 25 having an open lower face and a flange portion 26 having a horizontally long rectangular shape in plan view formed to project out to the front, rear, right, and left from a lower end of the main body portion 25. The flange portion 26 has an outer periphery attached to the upper casing 18.

The main body portion 25 has a horizontally long rectangular shape in plan view formed by drawing-forming a metal plate upward and includes a top surface portion 27, a front surface portion 28, a rear surface portion 29, and right and left side surface portions 30, 30. At boundary regions between the top surface portion 27 and the respective front, rear, right, and left surface portions, rounded portions 31, 31 . . . are formed. The rounded portions 31, 31 . . . curve downward as distance from the top surface portion 27 to the front, rear, right, and left is increased.

A support bar 22 (FIG. 1, FIG. 5) extending in a right-left direction is attached to the rear surface portion 29. The support bar 22 is secured to the installation plate 8 on the back plate 4 side.

In the top surface portion 27, a through hole 32 having a circular shape in plan view is provided. The through hole 32 is provided in the center of the right and left of the top surface portion 27 and biasedly to the rear. The through hole 32 has an inner edge on which a short tubular burring portion 33 rising upward is formed. Since folded portions of the heat transfer pipe 19 having a meandering shape project also to the rear of the upper casing 18 of the heat exchanger 12, the combustion device 10 is arranged biasedly to the front in the housing 2. Therefore, the through hole 32 and the burring portion 33 are positioned biasedly to the rear such that the connecting portion 14 is connectable to an existing air supply and exhaust pipe having a fixed outside position.

Figure 4A:
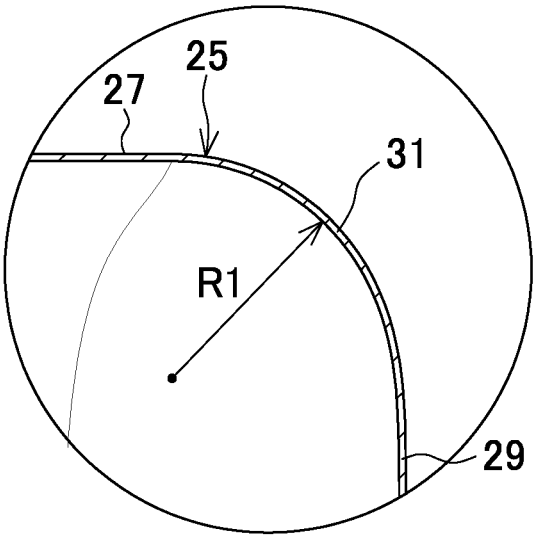
FIG. 4A illustrates a partial cross-sectional surface taken along the line A-A of FIG. 3.
Figure 4B:
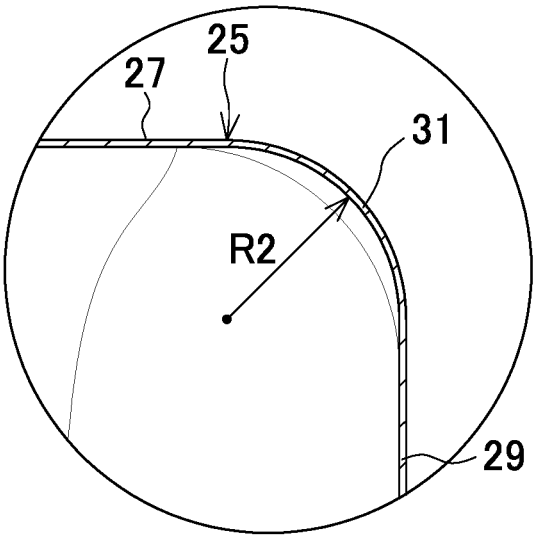
FIG. 4B illustrates a partial cross-sectional surface taken along the line B-B of FIG. 3.
Figure 4C:
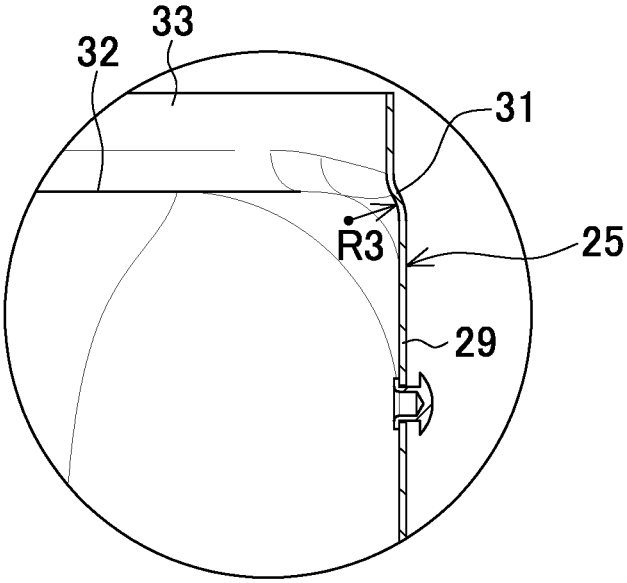
FIG. 4C illustrates a partial cross-sectional surface taken along the line C-C of FIG. 3.

The burring portion 33 has a rear end close to the rear surface portion 29. In view of this, the rear side rounded portion 31 (hereinafter denoted as "31A" when it is discriminated) formed between the top surface portion 27 and the rear surface portion 29 is formed so as to have a largest radius of curvature R1 at both right and left side parts apart from the through hole 32 as illustrated in FIG. 4A, a radius of curvature R2 gradually decreasing as approaching the through hole 32 from both the right and left side parts as illustrated in FIG. 4B, and a smallest radius of curvature R3 immediately behind the center of the right and left of the through hole 32 in FIG. 4C.

Accordingly, even when the through hole 32 is disposed biasedly to the rear of the top surface portion 27, the through hole 32 and the burring portion 33 do not overlap with the rear side rounded portion 31A. Therefore, the burring portion 33 can be easily formed in the flat top surface portion 27.

Figure 5:
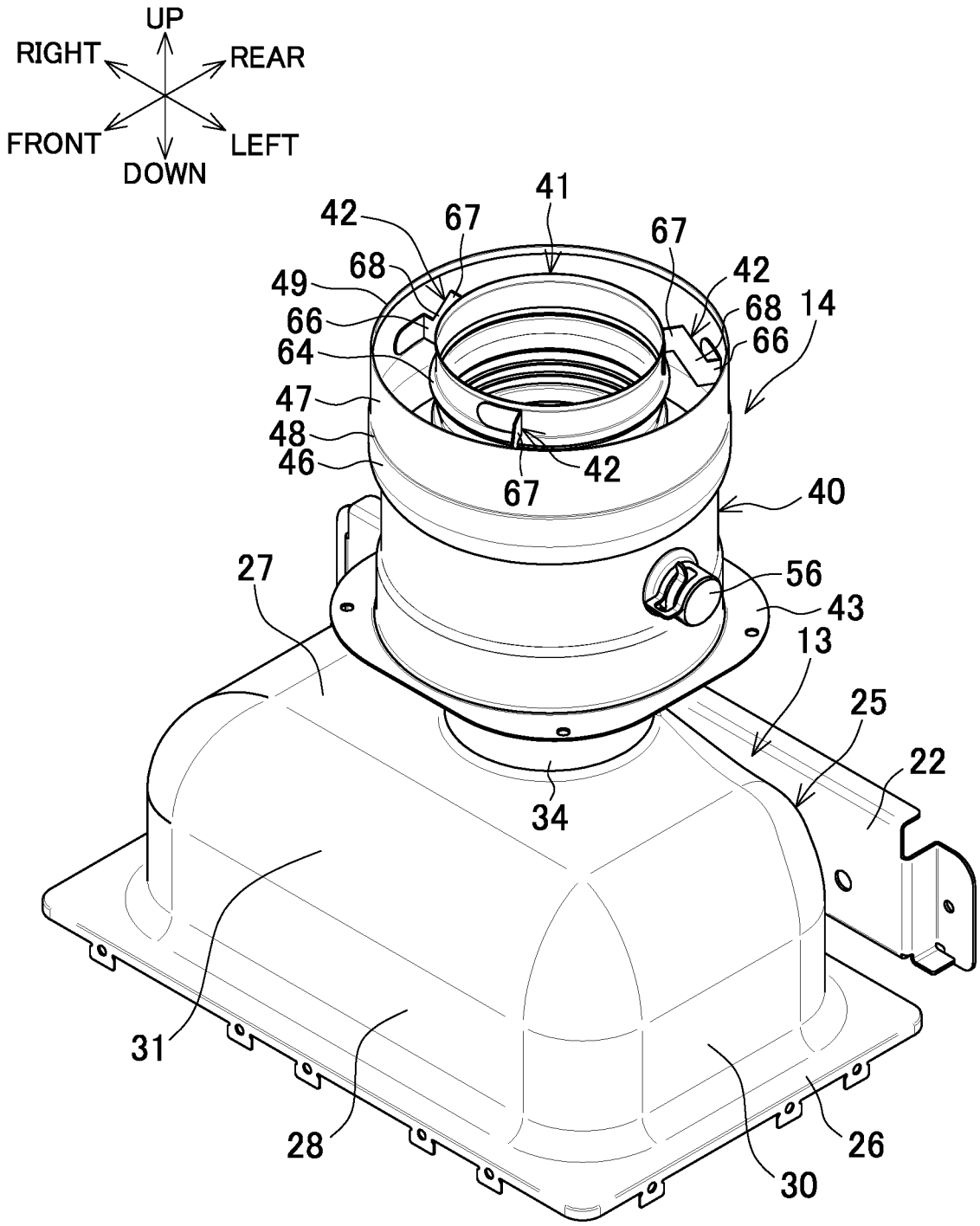
FIG. 5 is a perspective view from a front of the exhaust hood and a connecting portion.
Figure 6:
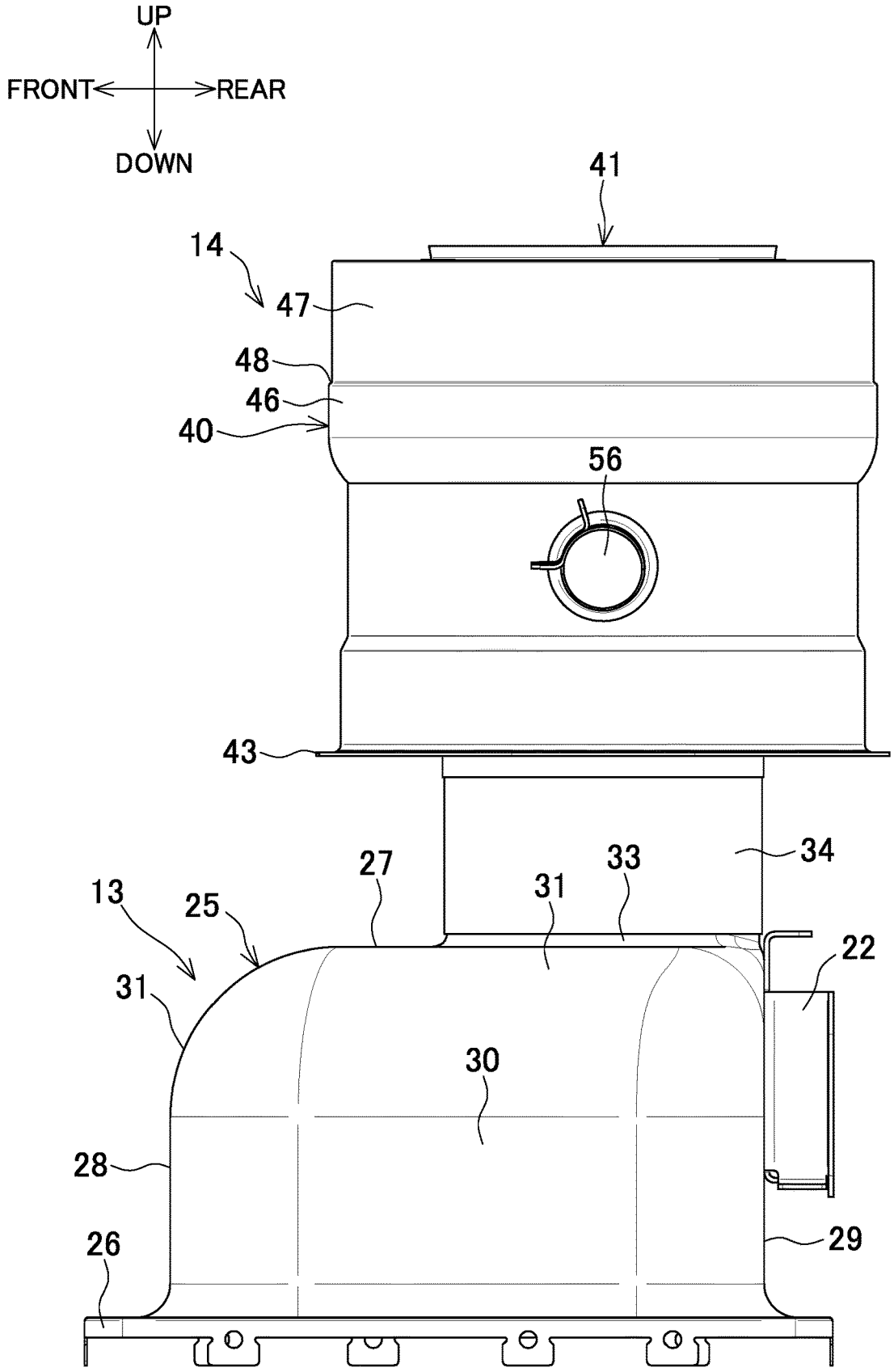
FIG. 6 is a side view of the exhaust hood and the connecting portion.
Figure 7:
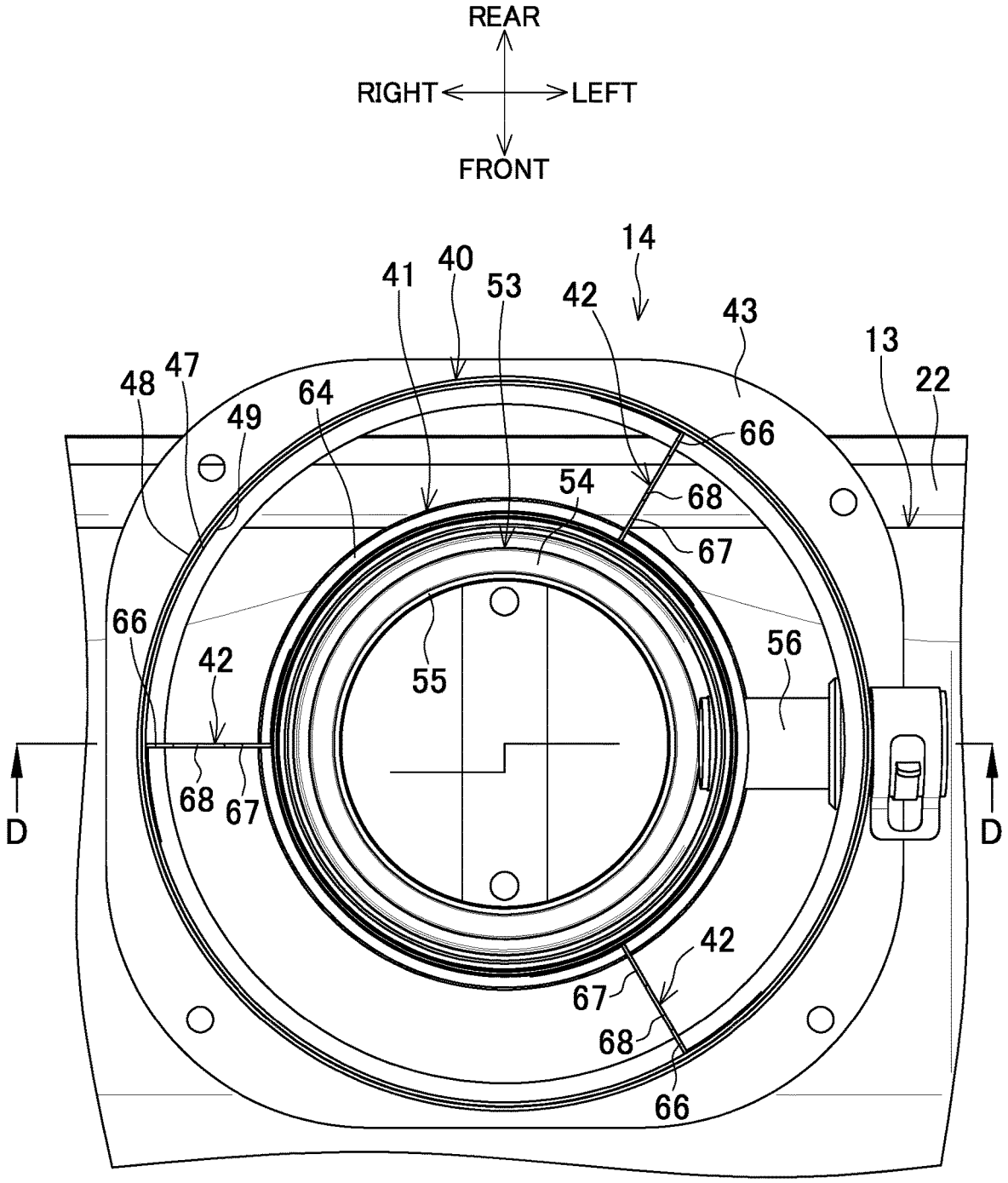
FIG. 7 is a plan view of a connecting portion part.
Figure 8:
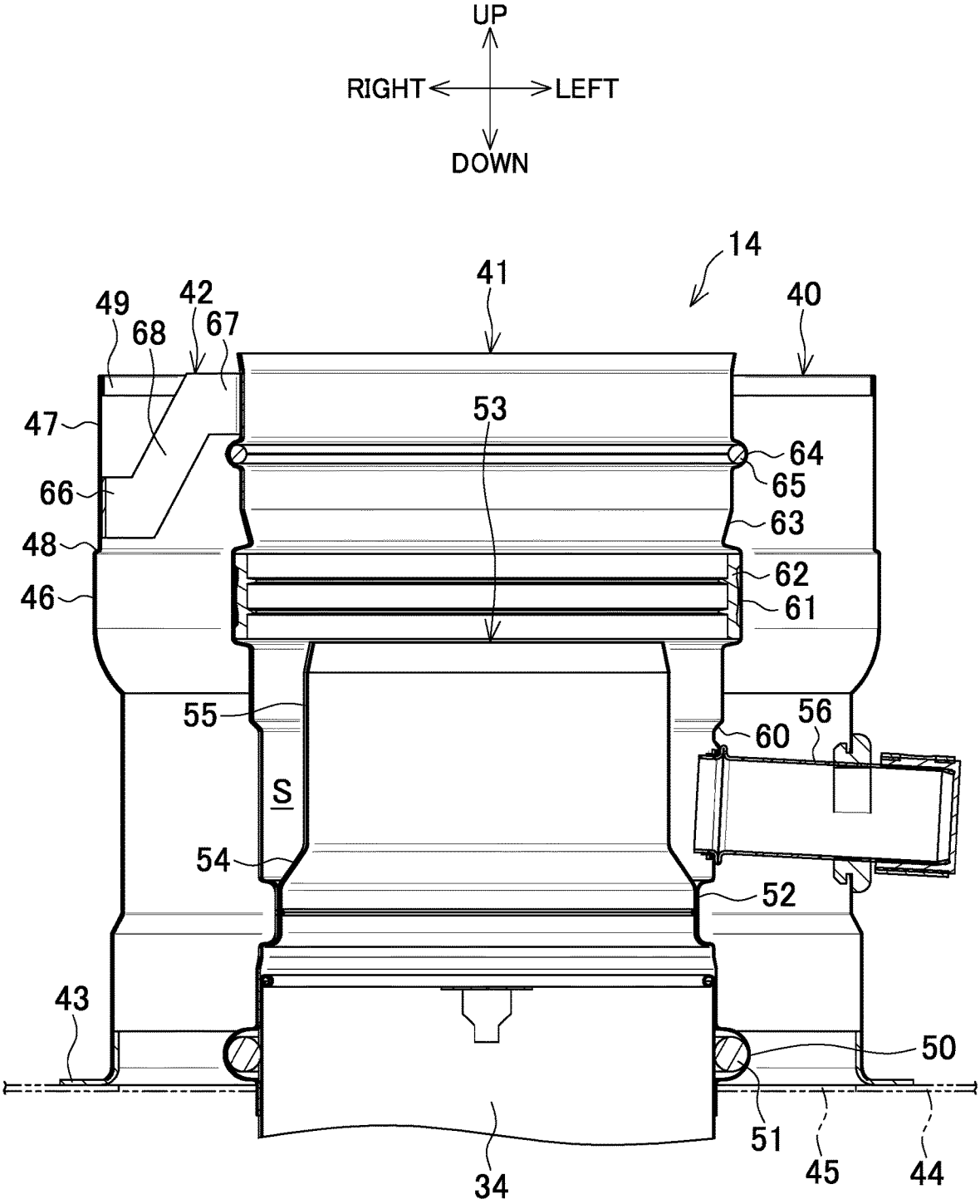
FIG. 8 is a partial cross-sectional view taken along the line D-D of FIG. 7.

FIG. 5 is a perspective view from the front of the exhaust hood 13 and the connecting portion 14 and FIG. 6 is a side view thereof. FIG. 7 is a plan view of a connecting portion part. FIG. 8 is a cross-sectional view taken along the line D-D of FIG. 7.

A tubular lower exhaust cylinder 34 is connected to the burring portion 33. The lower exhaust cylinder 34 is a cylinder externally fitted onto the burring portion 33 and extending upward.

The connecting portion 14 includes an outer cylinder 40, an inner cylinder 41, and connecting plates 42.

The outer cylinder 40 penetrates a through hole (not illustrated) provided in the top plate 6 of the box main body 3 and extends upward. A flange plate 43 projecting out to an outer side in a radial direction is attached to a lower end whole circumference of the outer cylinder 40. A receiving plate 44 (FIG. 1 and FIG. 8) to which the flange plate 43 is secured is disposed on the installation plate 8 above the exhaust hood 13. The receiving plate 44 has a bottom face in which a penetrating hole 45 that opens a lower end opening of the outer cylinder 40 into the housing 2 is formed.

The outer cylinder 40 has an upper portion in which an outer large diameter portion 46 expanding as heading upward and then having a larger diameter than a lower portion to extend upward is formed. An outer small diameter portion 47 having a decreased outer diameter is formed on an upper portion of the outer large diameter portion 46. Between the outer large diameter portion 46 and the outer small diameter portion 47, a step-like outer restricting portion 48 is formed over the whole circumference. The outer cylinder 40 has an upper end in which a folded portion 49 folded to an inner side is formed over the whole circumference.

The inner cylinder 41 is a cylinder having a lower end externally fitted onto the lower exhaust cylinder 34 in the outer cylinder 40 and extending upward. A ring-shaped lower holding portion 50 that holds an O-ring 51 abutting on an outer peripheral surface of the lower exhaust cylinder 34 is formed at the lower end of the inner cylinder 41. A narrowed portion 52 is formed above the lower holding portion 50. An upper exhaust cylinder 53 is disposed on the inner side of the narrowed portion 52. The upper exhaust cylinder 53 is a cylinder coaxially positioned above the lower exhaust cylinder 34 and is secured in a state where a lower portion outer peripheral surface of the upper exhaust cylinder 53 abuts on an inner peripheral surface of the narrowed portion 52 over the whole circumference. The upper exhaust cylinder 53 has an upper portion in which a tapered portion 54 tapered off as heading upward is formed. On the upper side of the tapered portion 54, a distal end portion 55 having a small diameter is formed upward. On the upper side of the narrowed portion 52, the inner cylinder 41 extends upward on the outer side of the distal end portion 55, and a ring-shaped space S is formed between the inner cylinder 41 and the distal end portion 55. In the space S, an end portion of a sensor cylinder 56 penetrating the outer cylinder 40 and the inner cylinder 41 from the outer side in the radial direction projects. The sensor cylinder 56 houses a temperature sensor (not illustrated) and is used to detect a temperature of combustion exhaust gas in the space S.

In the inner cylinder 41 on the outer side of the distal end portion 55, a lower restricting portion 60 in a tapered shape expanding as heading upward is formed. A strip-shaped middle holding portion 61 bulging to the outer side is formed on the upper side of the lower restricting portion 60. A strip ring-shaped sealing plate 62 is held on the inner side of the middle holding portion 61.

An upper restricting portion 63 in a tapered shape expanding as heading upward is formed on the upper side of the sealing plate 62. A ring-shaped upper holding portion 64 holding an O-ring 65 is formed on the upper side of upper restricting portion 63.

The connecting plate 42 is in a plate shape arranged in the radial direction between an inner peripheral surface of the outer cylinder 40 and an outer peripheral surface of the inner cylinder 41. Three connecting plates 42 are arranged at regular intervals in a circumferential direction of both cylinders 40, 41 and coaxially connects the outer cylinder 40 to the inner cylinder 41. Each of the connecting plates 42 is formed of a lower plate portion 66, an upper plate portion 67, and an inclined plate portion 68. The lower plate portion 66 is connected to the inner peripheral surface of the outer cylinder 40. The upper plate portion 67 is connected to the outer peripheral surface of the inner cylinder 41. The inclined plate portion 68 connects the lower plate portion 66 to the upper plate portion 67. The lower plate portion 66 is secured to an upper side with respect to the outer restricting portion 48 of the outer cylinder 40. The upper plate portion 67 is secured to an upper side with respect to the upper holding portion 64 of the inner cylinder 41.

In the water heater 1 configured as described above, as illustrated in FIG. 9 and FIG. 10, two types of a first air supply and exhaust pipe 70 and a second air supply and exhaust pipe 80 are selectively connectable to the connecting portion 14.

First, the first air supply and exhaust pipe 70 coaxially includes a first air supply pipe 71 and a first exhaust pipe 72.

The first air supply pipe 71 is a cylinder having an outer diameter that allows interpolation by inserting into the outer cylinder 40 of the connecting portion 14 from above the outer cylinder 40. The first air supply pipe 71 has a lower end that can abut on upper ends of the lower plate portions 66 of the connecting plates 42 in association with the insertion into the outer cylinder 40.

The first exhaust pipe 72 is a cylinder having an outer diameter that allows interpolation by inserting into the inner cylinder 41 from above the inner cylinder 41. The first exhaust pipe 72 has a lower end portion projecting downward with respect to the lower end of the first air supply pipe 71 and forming a first tapered portion 73 reducing in diameter as heading downward. The first tapered portion 73 can abut on the upper restricting portion 63 disposed in the inner cylinder 41 in association with the insertion into the inner cylinder 41.

Figure 9:
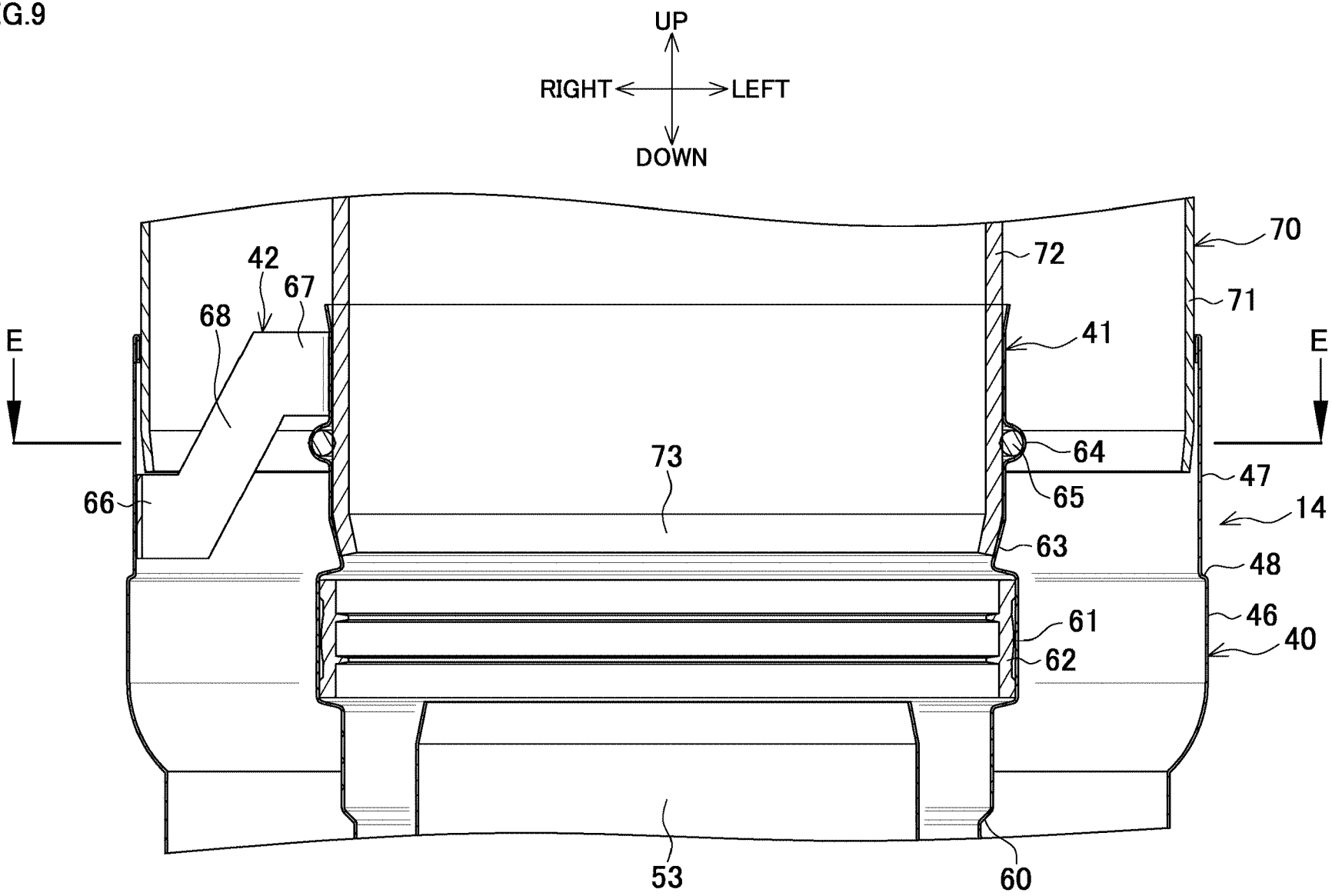
FIG. 9 is a partial cross-sectional view corresponding to the cross-sectional surface taken along the line D-D of FIG. 7 that illustrates a state where a first air supply and exhaust pipe is connected.
Figure 11:
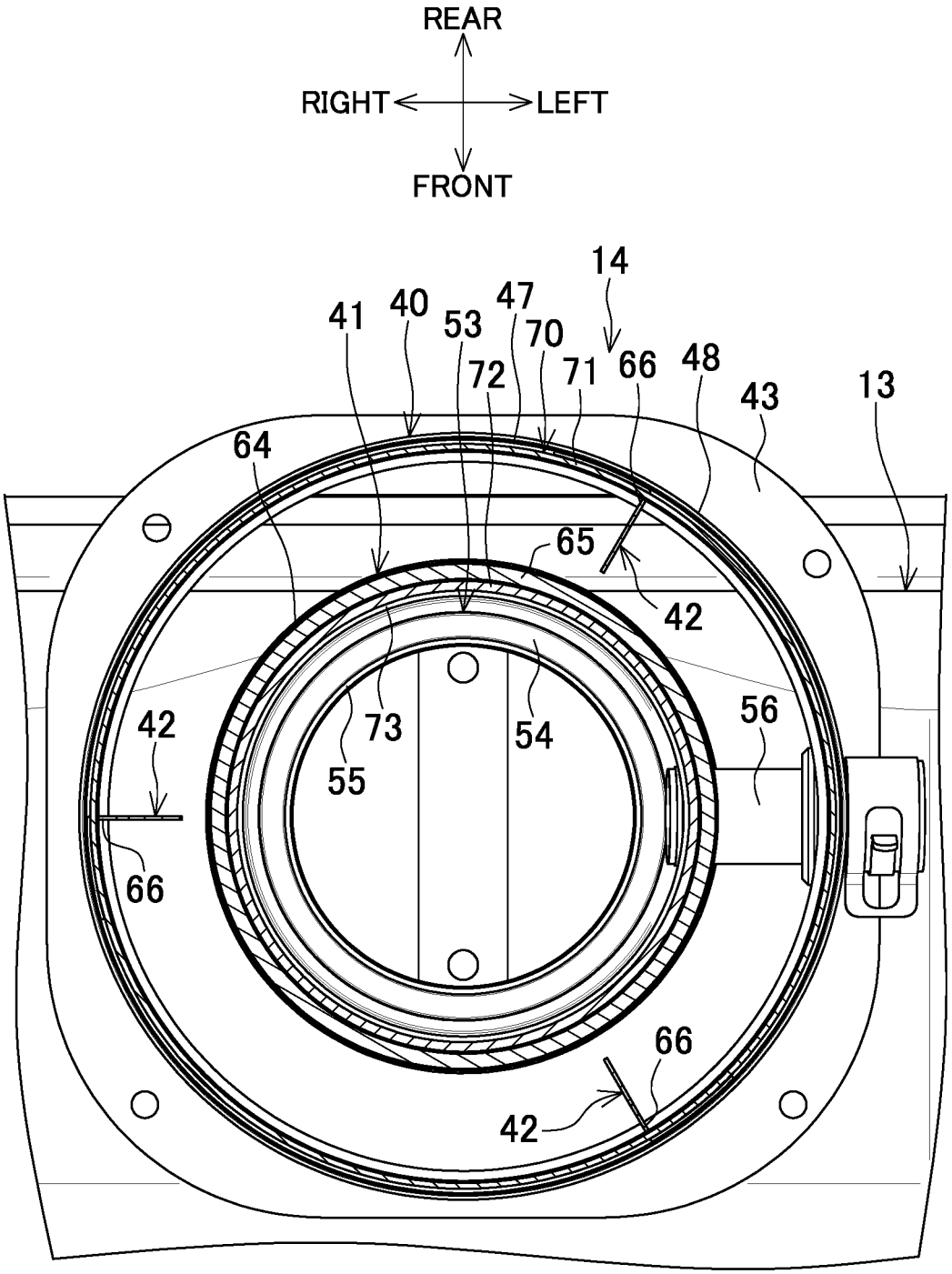
FIG. 11 is a cross-sectional view taken along the line E-E of FIG. 9.

Accordingly, when the first air supply and exhaust pipe 70 is connected to the connecting portion 14, the first air supply pipe 71 and the first exhaust pipe 72 are inserted respectively into the outer cylinder 40 and the inner cylinder 41 from above the outer cylinder 40 and the inner cylinder 41. Then, as illustrated in FIG. 9 and FIG. 11, the lower end of the first air supply pipe 71 abuts on the upper ends of the lower plate portions 66 of the respective connecting plates 42, and the first tapered portion 73 of the first exhaust pipe 72 abuts on the upper restricting portion 63 of the inner cylinder 41, thereby restricting further interpolation. At this time, the O-ring 65 on the inner cylinder 41 abuts on an outer peripheral surface of the first exhaust pipe 72 over the whole circumference to seal between the inner cylinder 41 and the first exhaust pipe 72.

Next, the second air supply and exhaust pipe 80 coaxially includes a second air supply pipe 81 and a second exhaust pipe 82. The second air supply pipe 81 is a cylinder having an inner diameter that allows externally fitting onto the outer cylinder 40 of the connecting portion 14 from above the outer cylinder 40. The second air supply pipe 81 has a lower portion in which a second lower abutting portion 83 in a tapered shape expanding as heading downward is disposed. The second lower abutting portion 83 can abut on the outer restricting portion 48 disposed in the outer cylinder 40 in association with the external fitting onto the outer cylinder 40. A second upper abutting portion 84 in a tapered shape expanding as heading downward is disposed also above the second lower abutting portion 83. The second upper abutting portion 84 can abut on the folded portion 49 on an upper end of the outer cylinder 40 simultaneously when the second lower abutting portion 83 abuts on the outer restricting portion 48.

The second exhaust pipe 82 is a cylinder having an outer diameter that allows interpolation by inserting into the inner cylinder 41 from above the inner cylinder 41. The second exhaust pipe 82 has a lower portion having an outer diameter smaller than the outer diameter of the first exhaust pipe 72 of the first air supply and exhaust pipe 70 and an inner diameter of the upper restricting portion 63 of the inner cylinder 41. The second exhaust pipe 82 has a lower end portion projecting downward with respect to a lower end of the second air supply pipe 81. On the lower end portion of the second exhaust pipe 82, a second tapered portion 85 reducing in diameter as heading downward is disposed.

Figure 10:
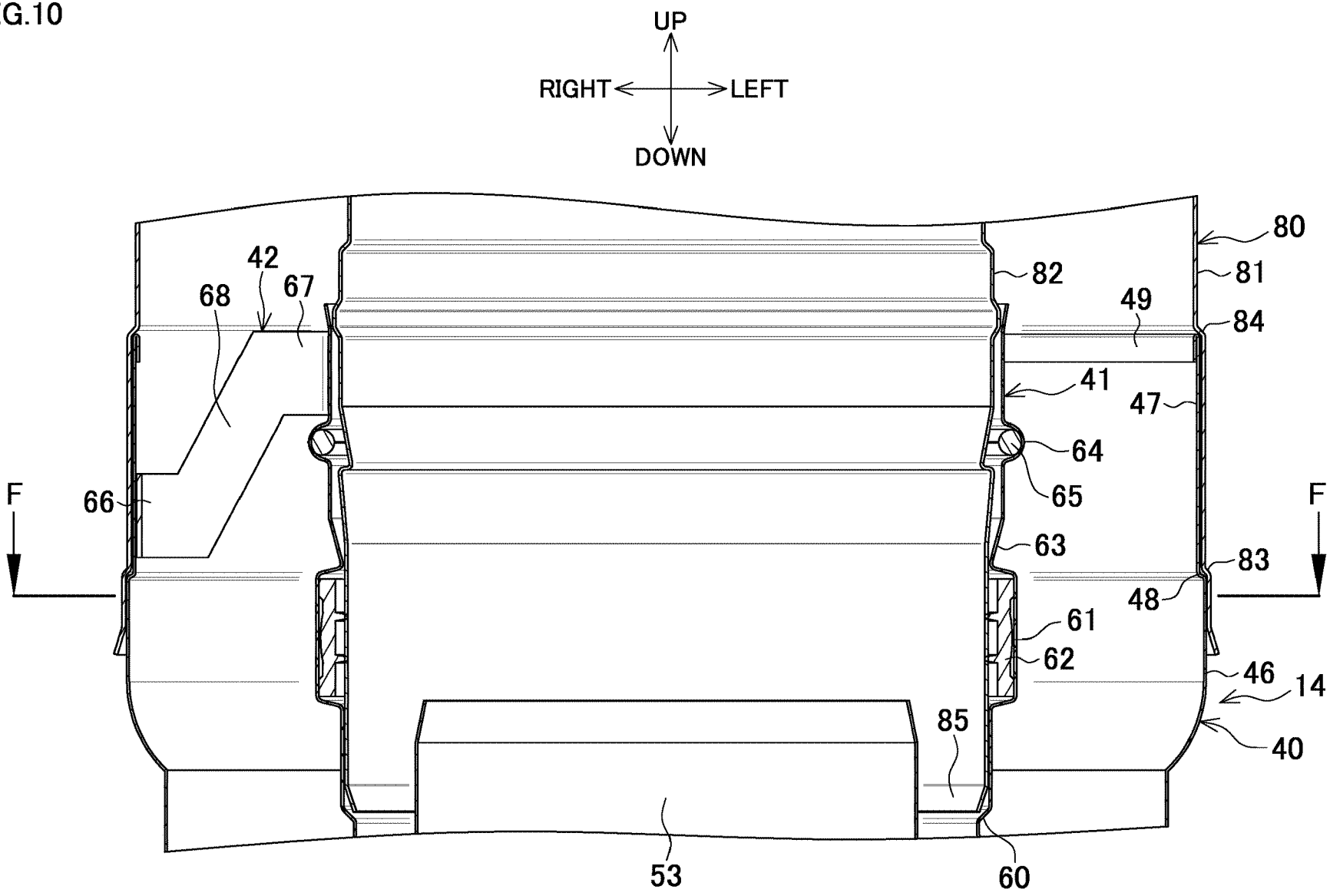
FIG. 10 is a partial cross-sectional view corresponding to the cross-sectional surface taken along the line D-D of FIG. 7 that illustrates a state where a second air supply and exhaust pipe is connected.
Figure 12:
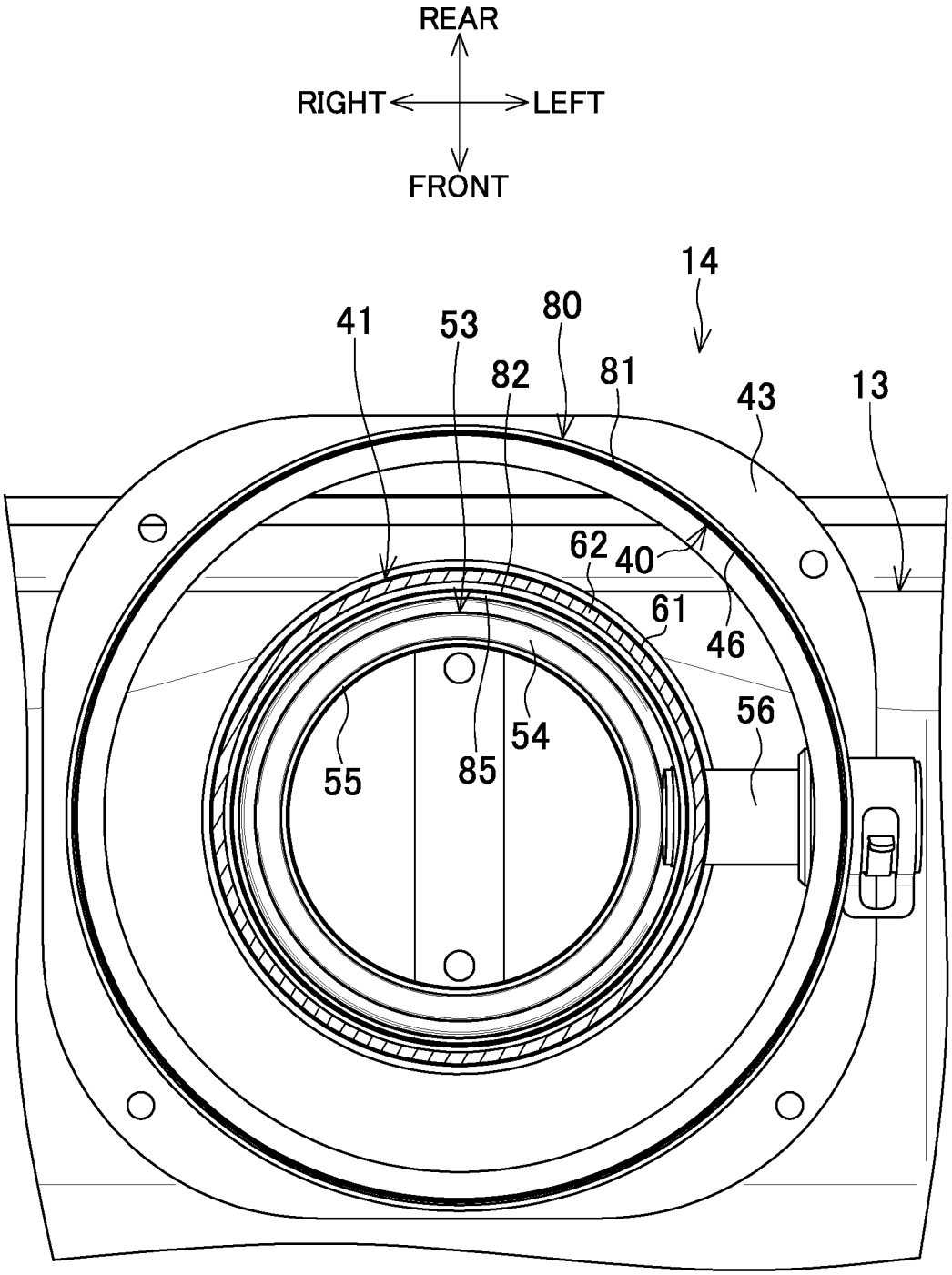
FIG. 12 is a cross-sectional view taken along the line F-F of FIG. 10.

Accordingly, when the second air supply and exhaust pipe 80 is connected to the connecting portion 14, the second air supply pipe 81 is externally fitted onto the outer cylinder 40 from above the outer cylinder 40, and the second exhaust pipe 82 is inserted into the inner cylinder 41 from above the inner cylinder 41. Then, as illustrated in FIG. 10 and FIG. 12, the second lower abutting portion 83 of the second air supply pipe 81 abuts on the outer restricting portion 48 of the outer cylinder 40, and the second upper abutting portion 84 abuts on the folded portion 49, thereby restricting further external fitting. At this time, the second exhaust pipe 82 passes the O-ring 65 and the sealing plate 62, and the second tapered portion 85 at the lower end comes close to or abuts on the lower restricting portion 60. In the insertion state, a lip on an inner peripheral surface of the sealing plate 62 abuts on an outer peripheral surface of the second exhaust pipe 82 over the whole circumference to seal between the inner cylinder 41 and the second exhaust pipe 82.

Effects of disclosure according to the connecting portion for connection to the air supply and exhaust pipe are describe as follows.

In the water heater 1 of the above-described embodiment, the first air supply and exhaust pipe 70 and the second air supply and exhaust pipe 80 are selectively connectable to the connecting portion 14. The first air supply and exhaust pipe 70 coaxially includes the first air supply pipe 71 corresponding to the outer cylinder 40 and the first exhaust pipe 72 corresponding to the inner cylinder 41. The second air supply and exhaust pipe 80 coaxially includes the second air supply pipe 81 corresponding to the outer cylinder 40 and having an inner diameter larger than the outer diameter of the first air supply pipe 71 and the second exhaust pipe 82 corresponding to the inner cylinder 41.

To the connecting portion 14, the first air supply and exhaust pipe 70 is connectable by interpolating the first air supply pipe 71 into the outer cylinder 40 and interpolating the first exhaust pipe 72 into the inner cylinder 41, and the second air supply and exhaust pipe 80 is connectable by externally fitting the second air supply pipe 81 onto the outer cylinder 40 and interpolating the second exhaust pipe 82 into the inner cylinder 41.

With the configuration, both the two types of first and second air supply and exhaust pipes 70, 80 having different diameters are connectable to the connecting portion 14.

The outer diameter of the lower portion of the second exhaust pipe 82 is smaller than the outer diameter of the lower portion of the first exhaust pipe 72. In the outer cylinder 40, the lower plate portions 66 of the connecting plates 42, that is, an exemplary first air supply pipe restricting portion, are disposed on the inner surface and the outer restricting portion 48, that is, an exemplary second air supply pipe restricting portion, is disposed on the outer surface, separately at the upper and lower parts, respectively. The lower plate portions 66 restrict an interpolation position of the first air supply pipe 71. The outer restricting portion 48 restricts an external fitting position of the second air supply pipe 81.

On the other hand, in the inner cylinder 41, the upper restricting portion 63, that is, an exemplary first exhaust pipe restricting portion, and the lower restricting portion 60, that is, an exemplary second exhaust pipe restricting portion, are disposed. The upper restricting portion 63 restricts an interpolation position of the first exhaust pipe 72. The lower restricting portion 60 restricts an interpolation position of the second exhaust pipe 82 at a lower position than the upper restricting portion 63.

On the inner peripheral surface of the inner cylinder 41, the O-ring 65, that is, an exemplary first sealing member, and the sealing plate 62, that is, an exemplary second sealing member, are disposed separately at the upper and lower parts, respectively. The O-ring 65 abuts on the outer peripheral surface of the interpolated first exhaust pipe 72. The sealing plate 62 abuts on the outer peripheral surface of the interpolated second exhaust pipe 82.

When the first air supply and exhaust pipe 70 is connected to the connecting portion 14, the interpolation of the first air supply pipe 71 interpolated into the outer cylinder 40 is restricted by the lower plate portions 66, the interpolation of the first exhaust pipe 72 interpolated into the inner cylinder 41 is restricted by the upper restricting portion 63, and the O-ring 65 abuts on the outer peripheral surface of the first exhaust pipe 72.

On the other hand, when the second air supply and exhaust pipe 80 is connected to the connecting portion 14, the external fitting of the second air supply pipe 81 externally fitted onto the outer cylinder 40 is restricted by the outer restricting portion 48, the interpolation of the second exhaust pipe 82 interpolated into the inner cylinder 41 is restricted by the lower restricting portion 60, and the sealing plate 62 abuts on the outer peripheral surface of the second exhaust pipe 82.

With the configuration, the first and second air supply and exhaust pipes 70, 80 are connectable to the connecting portion 14 at appropriate positions. Moreover, it is possible to reliably seal between the inner cylinder 41 and the first and second exhaust pipes 72, 82, thus allowing avoidance of combustion exhaust gas leakage.

The upper restricting portion 63 is a tapered portion tapered off as heading downward and having a diameter smaller than the outer diameter of the lower end of the first exhaust pipe 72 and larger than the outer diameter of the second exhaust pipe 82.

Accordingly, the first exhaust pipe 72 can be appropriately positioned while allowing passage of the second exhaust pipe 82 longer downward than the first exhaust pipe 72.

Between the inner surface of the outer cylinder 40 and the outer surface of the inner cylinder 41, the connecting plates 42, that is, an exemplary connecting member, coaxially connecting both cylinders 40, 41 are installed. The upper ends of the lower plate portions 66, which are connecting parts in the connecting plates 42 for connection to the inner surface of the outer cylinder 40, double as the first air supply pipe restricting portion.

Accordingly, insertion of the first air supply pipe 71 can be restricted using the connecting plates 42, thus resulting in a rational configuration with the number of components reduced.

The following describes a modification example according to the disclosure of the connecting portion of the air supply and exhaust pipe.

In the above-described embodiment, the first and second exhaust pipes of the first and second air supply and exhaust pipes have different downward projection lengths to the connecting portion, and the second exhaust pipe is longer than the first exhaust pipe. However, the configuration may be reversed, or both exhaust pipes may have the same length. In this case, the first exhaust pipe restricting portion and the second exhaust pipe restricting portion can double as one another, that is, in the above-described embodiment, any one of the O-ring and the sealing plate is used.

In the above-described embodiment, the first air supply pipe restricting portion doubles as connecting plates, but the first air supply pipe restricting portion may be formed separately from the connecting plates.

The connecting member is not limited to the connecting plates of the above-described embodiment. The number and shape of the connecting member are changeable as necessary. For example, a rod-shaped connecting member may be installed in the radial direction between an outer cylinder and an inner cylinder.

While the second air supply pipe restricting portion and the first and second exhaust pipe restricting portions are restricting portions in tapered shapes in the above-described embodiment, the restricting portions are not limited thereto and may be formed by ribs, projections, or the like projecting in the radial direction.

In the above-described embodiment, in a connection state of the first air supply and exhaust pipe, the first air supply pipe abuts on the first air supply pipe restricting portion, and the first exhaust pipe abuts on the first exhaust pipe restricting portion. However, the configuration may be such that only any one of the first air supply pipe and the first exhaust pipe abuts on the corresponding restricting portion and the other comes close to the corresponding restricting portion to have movement restricted. The same applies to the second air supply and exhaust pipe.

In the above-described embodiment, a lower exhaust cylinder of an exhaust hood need not be arranged biasedly to the rear.

Effects of disclosure according to the exhaust hood are described as follows.

The water heater 1 of the above-described embodiment includes the housing 2 having a rear face that is an installation surface to a vertical plane and the combustion device 10 disposed in the housing 2 and including the burner unit 11, that is, an exemplary burner, the heat exchanger 12 on the upper side of the burner unit 11, and the exhaust hood 13 disposed on the upper side of the heat exchanger 12. The exhaust hood 13 has an upper surface to which the lower exhaust cylinder 34, that is, an exemplary exhaust cylinder, is connected. The exhaust hood 13 is formed by drawing into an upward bulged shape in which the top surface portion 27 has a planar surface with a rectangular shape in plan view and its four side are continuous to the respective front, rear, right, and left surfaces via the rounded portions 31. The burring portion 33 to which the lower exhaust cylinder 34 is connected is formed to rise at a peripheral edge of the through hole 32 formed in the top surface portion 27.

The through hole 32 is arranged at a position biased to the rear from the center in a front-rear direction of the top surface portion 27. The rounded portion 31A on the rear side of the top surface portion 27 is formed such that the radii of curvature R1 to R3 gradually decrease as approaching from the outer side in the right-left direction to the through hole 32.

With the configuration, the position of the burring portion 33 does not extend over the flat top surface portion 27 of the exhaust hood 13 or the rounded portion 31A on its rear side. Accordingly, even when the exhaust hood 13 having the burring portion 33 at a position biased to the rear is used, the burring portion 33 can be formed without distortion, and the dimensional accuracy of the burring portion 33 can be maintained.

The following describes a modification example according to the disclosure of the exhaust hood.

A main body portion of the exhaust hood need not have a rectangular shape extending in the right-left direction in plan view like the above-described embodiment. The main body portion may have a rectangular shape extending in the front-rear direction in plan view or a square shape in plan view.

While a burring portion is arranged in the center in the right-left direction of a top surface portion in the above-described embodiment, the burring portion may be arranged biasedly to any of the right or left. In this case as well, it is only necessary to form a rear side rounded portion so as to have a radius of curvature that decreases as approaching the burring portion.

The position biased to the rear of the burring portion is not limited thereto in the above-described embodiment and may be a position closer to the center than that in the above-described embodiment.

Additionally, in common to the respective disclosures, the water heater may be a latent heat recovery type having a primary heat exchanger and a secondary heat exchanger.

The heat exchanger may be one that has two divided circuits of a hot-water supply circuit and another circuit, such as a bath circuit and a heating circuit.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

The invention claimed is:

1. A water heater connectable to an external air supply and exhaust pipe coaxially including an outer side air supply pipe and an inner side exhaust pipe, the water heater comprising:

a housing that houses a combustion device including a fan;

a connecting portion configured to connect to the external air supply and exhaust pipe, the connection portion including an outer cylinder and an inner cylinder projecting upward from an upper surface of the housing, the outer cylinder configured to take in air into the housing in association with driving of the fan, the inner cylinder being coaxially arranged in the outer cylinder, the inner cylinder configured for discharging combustion exhaust gas that has passed through the combustion device;

a first air supply and exhaust pipe coaxially including a first air supply pipe corresponding to the outer cylinder and a first exhaust pipe corresponding to the inner cylinder; and a second air supply and exhaust pipe coaxially including a second air supply pipe corresponding to the outer cylinder and having an inner diameter larger than an outer diameter of the first air supply pipe and a second exhaust pipe corresponding to the inner cylinder, wherein the first air supply and exhaust pipe and the second air supply and exhaust pipe are selectively connectable to the connecting portion, the first air supply and exhaust pipe is configured to connect to the connecting portion by interpolating the first air supply pipe into the outer cylinder and interpolating the first exhaust pipe into the inner cylinder, and the second air supply and exhaust pipe is connectable to the connecting portion by externally fitting the second air supply pipe onto the outer cylinder and interpolating the second exhaust pipe into the inner cylinder.

2. The water heater according to claim 1, wherein an outer diameter of a lower portion of the second exhaust pipe is smaller than an outer diameter of a lower portion of the first exhaust pipe, a first air supply pipe restricting portion is disposed on an inner surface of the outer cylinder, and a second air supply pipe restricting portion is disposed on an outer surface of the outer cylinder, separately at upper and lower parts, respectively, the first air supply pipe restricting portion restricting an interpolation position of the first air supply pipe, the second air supply pipe restricting portion restricting an external fitting position of the second air supply pipe, a first exhaust pipe restricting portion and a second exhaust pipe restricting portion are disposed on the inner cylinder, the first exhaust pipe restricting portion restricting an interpolation position of the first exhaust pipe, the second exhaust pipe restricting portion restricting an interpolation position of the second exhaust pipe at a lower position than the first exhaust pipe restricting portion, a first sealing member and a second sealing member are disposed separately at upper and lower parts on an inner peripheral surface of the inner cylinder, respectively, the first sealing member abutting on an outer peripheral surface of the interpolated first exhaust pipe, the second sealing member abutting on an outer peripheral surface of the interpolated second exhaust pipe, when the first air supply and exhaust pipe is connected to the connecting portion, interpolation of the first air supply pipe interpolated into the outer cylinder is restricted by the first air supply pipe restricting portion, interpolation of the first exhaust pipe interpolated into the inner cylinder is restricted by the first exhaust pipe restricting portion, and the first sealing member abuts on the outer peripheral surface of the first exhaust pipe, and when the second air supply and exhaust pipe is connected to the connecting portion, external fitting of the second air supply pipe externally fitted onto the outer cylinder is restricted by the second air supply pipe restricting portion, interpolation of the second exhaust pipe interpolated into the inner cylinder is restricted by the second exhaust pipe restricting portion, and the second sealing member abuts on the outer peripheral surface of the second exhaust pipe.

3. The water heater according to claim 2, wherein the first exhaust pipe restricting portion is a tapered portion tapered off as heading downward and having a diameter smaller than an outer diameter of a lower end of the first exhaust pipe and larger than an outer diameter of the second exhaust pipe.

4. The water heater according to claim 2, wherein a connecting member coaxially connecting both cylinders is installed between an inner surface of the outer cylinder and an outer surface of the inner cylinder, and an upper end of a connecting part in the connecting member for connection to the inner surface of the outer cylinder is doubled as the first air supply pipe restricting portion.

* * * * *